United States Patent [19]

Hupp et al.

[11] Patent Number: 4,815,356

[45] Date of Patent: Mar. 28, 1989

[54] BREECH LOCK MECHANISM FOR AUTOMATIC FIREARMS

[75] Inventors: Gerhard Hupp, Oberndorf; Helmut Mäder, Schramberg, both of Fed. Rep. of Germany

[73] Assignee: Mauser-Werke Oberndorf GmbH, Oberndorf, Fed. Rep. of Germany

[21] Appl. No.: 601,100

[22] Filed: Apr. 17, 1984

Related U.S. Application Data

[63] Continuation of Ser. No. 326,199, Dec. 1, 1981, abandoned.

[30] Foreign Application Priority Data

Dec. 5, 1980 [DE] Fed. Rep. of Germany ..... 3045831

[51] Int. Cl.[4] ..... F41D 11/06; F16C 33/24

[52] U.S. Cl. ..... 89/190; 384/282

[58] Field of Search ..... 89/168, 176, 190; 384/912, 282, 284, 285; 308/DIG. 8, 3 R, DIG. 9, 241, 239

[56] References Cited

U.S. PATENT DOCUMENTS

| | | | |
|---|---|---|---|
| 1,637,317 | 7/1927 | Shoemaker | 384/284 |
| 3,348,453 | 10/1967 | Muhlemann | 89/190 |
| 3,872,771 | 3/1975 | Pierre et al. | 89/190 |
| 3,872,772 | 3/1975 | Walters . | |
| 4,265,498 | 5/1981 | Luce et al. | 384/912 X |
| 4,397,214 | 8/1983 | Mannhart et al. | 89/190 X |

FOREIGN PATENT DOCUMENTS

| | | |
|---|---|---|
| 2044964 | 3/1972 | Fed. Rep. of Germany . |
| 7804099 | 8/1979 | Fed. Rep. of Germany . |
| 3129361 | 4/1982 | Fed. Rep. of Germany . |
| 3045831 | 6/1982 | Fed. Rep. of Germany . |

OTHER PUBLICATIONS

Hütte, 27 Auflage, 1 Band, p. 865.

*Primary Examiner*—John S. Maples

*Attorney, Agent, or Firm*—Scully, Scott, Murphy & Presser

[57] ABSTRACT

A breech lock mechanism for automatic firearms, in particular, a rigidly closing breech lock mechanism with loosely located support flaps in its breech head which will slide along an associated and complementary formed latching and unlatching component into its rearward latching position during the opening of the breech lock mechanism. The surfaces of the support flaps which face towards the latching and unlatching component are at least partly provided with a lubricating layer whose hardness is different with respect to the complementary latching and unlatching component.

1 Claim, 1 Drawing Sheet

BREECH LOCK MECHANISM FOR AUTOMATIC FIREARMS

This is a continuation of co-pending application Ser. No. 326,199, filed Dec. 1, 1981, now abandoned.

BACKGROUND OF THE INVENTION

1. Field of the Invention

The present invention relates to a breech lock mechanism for automatic firearms, and in particular, a rigidly closing breech lock mechanism with loosely located support flaps in its breech head which will slide along an associated and complementary formed latching and unlatching component into its rearward latching position during the opening of the breech lock mechanism.

Modern automatic firearms having calibers in the magnitude of 20 to 40 millimeters will, as a rule, evidence high firing cadences or rates.

These cadences are required so that, within the shortest possible time, it is possible to direct a large number of projectiles into the target, such as flying objects or the like moving in the sonic range.

Due to these high cadences, as well as high internal pressures, the breech lock mechanisms of automatic firearms are subjected to extremely high mechanical loads. These high loads are particularly applicable to the movable firearm or breech mechanism components, however, above all with respect to the friction forces which are encountered between these components.

The readiness for use of automatic firearms of that type must be afforded in the case of combat under all possible contemplated environmental influences and weather conditions. The readiness for use has hereby, above all, set particular limitations when, for example, due to the penetration of rain water, snow or the like, the lubricating film which is present between the sliding components is destroyed, which is additionally propagated through high specific surface pressures produced, for instance, during the opening of the breech lock mechanism. A lubricating film which is present between the sliding components, as well as rain water, is completely squeezed away so that already after only a few shots unprotected metal components impact against each other, and due to scoring there will be encountered irreparable damage. Thus, from the stand point of combat tactics as well as technological reasons negative defects or damage of that type must be avoided.

2. Discussion of the Prior Art

Investigations have already been undertaken concerning the elimination of damages of that type through suitable material selection and/or chromium plating or nitriding. However, a fully satisfying solution could be achieved neither with means of that type nor through the use of synthetic lubricating agents, such as are known, for example, under the trade names "Molykote" or "Liquimoly".

In order to obviate these shortcomings and disadvantages, it is an object of the present invention to so configure the inner surfaces of the support flaps which slide along the latching and unlatching component during the opening of the firearm breech lock mechanism, through the intermediary of corresponding material combinations, that the operability of the weapon itself will remain intact even under extreme environmental conditions.

SUMMARY OF THE INVENTION

The foregoing object is achieved in an inventive manner in that the surfaces of the support flaps which face towards the latching and unlatching component are at least partly provided with a lubricating layer whose hardness is different with respect to the complementary latching and unlatching component.

The hardness of the sliding layer is different from the hardness of the latching and unlatching element of the breech lock which slide on the sliding layer, so as to thereby achieve constant lubrication even upon stripping off of an oil lubricating film thereon. The different hardnesses of the two components which slide against each other avoids a binding engagement and thereby the destruction of the sliding components. In effect, the sliding layer is rubbed off due to its lower hardness relative to the latching component, which concurrently replaces the lubricating effect without the utilization of a special lubricating means.

As a result of suitable configuring and perfecting, the proposed inventive structure contemplates that the lubricating layer consists of a metal alloy with low coefficients of friction, such as nickel-copper or the like. The lubricating layer, pursuant to another inventive feature, evidences a thickness in the magnitude of 0.2 to 0.5 millimeter. Pursuant to a further inventive feature, the coating is applied in a bed formed in the surfaces of the support flaps which, for example, may include undercuts.

Through the proposed invention there are thus obtained a series of pronounced advantages:

As investigations have clearly and undoubtedly indicated, a weapon which is provided with the inventively coated support flags remains operational and serviceable for a lengthy period of time under all conceivable environmental conditions, in particular, under rain and snow. Through this alone, there is already afforded that in the case of combat, the firearm is always available in complete readiness for its contemplated purpose.

The at least partial coating of the surfaces of the support flaps facing towards the latching and unlatching component can be produced without any difficulties well before assembly.

In order to impart a high life expectancy to the coating, it has been ascertained as being advantageous that the part section of the support flaps which is to be coated can be slightly undercut through machining so as to form a kind of bed. Hereby, in combination with an undercut of the edges of the bed, besides an improved retention there is concurrently achieved a planority with the uncoated portion of the support flaps.

BRIEF DESCRIPTION OF THE DRAWINGS

Reference may now be had to the following detailed description of an exemplary embodiment of the invention, taken in conjunction with the accompanying drawings in which.

DETAILED DESCRIPTION

Figure 1:
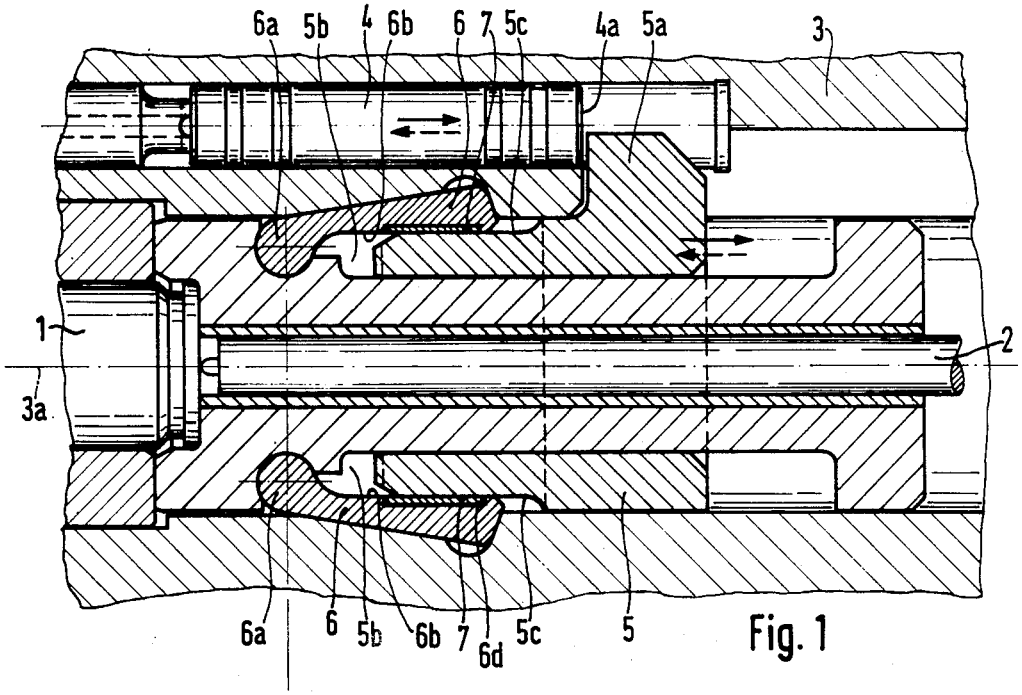
FIG. 1 illustrates a partially-sectioned plan view of the breech lock mechanism support flap arrangement.
Figure 2:
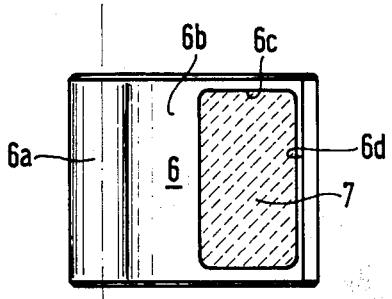
FIG. 2 illustrates a coated support flap.

After explosion of the primer cap (not shown) which is located in the shell casing 1 by means of firing pin 2, a partial gas flow which is produced during the burning down of the propellant charge powder, is discharged in a known manner from the weapon barrel. This partial gas flow acts on a piston 4 arranged in the weapon housing 3 parallel relative to the axis of the weapon bore 30. The surface 4*a* of the piston 4 again acts impactlike on the projection 5*a* of the latching and unlatching component which is designated in its entirely with the reference numeral 5. This is projected by the impact so far during the described operational sequence in the direction of the extended arrow, in essence towards the right, that the support flaps 6 will pivot about the points of rotation 6*a* into the recesses 5*b* of the latching and unlatching component 5 and retain the latter in the open position.

Upon the moving back of the latching and unlatching component 5 into the open position of the breech lock mechanism (extended arrow), these surfaces 5*c* slide under a specific high surface pressure along the therewith complementary formed inner surfaces 6*b* of the support flaps 6. The permanent slidability (and concurrently also the operability of the weapon itself) of the surfaces 5*c* on the complementary surface 6*b* is afforded through the application of a lubricating layer 7 on or in the surfaces 6*b*. The application of the lubricating layer 7 is hereby preferably effected in a galvanic manner. At given prerequisites the application of the lubricating layer 7 can, however, also be effected by means of surface welding, soldering or the like.

Through machining there can be formed a bed 6*c* for the lubricating layer 7, which can evidence undercuts 6*c* for this purpose.

In this manner, the surfaces of the support flaps 6 which face towards the latching and unlatching component 5 are at least partly provided with a lubricating layer 7, whose hardness is different with respect to the complementary latching and unlatching component. The hardness of the sliding layer 7 is different from the hardness of the latching and unlatching element 5 of the breech lock which slide on the sliding layer, so as to thereby achieve constant lubrication even upon stripping off of an oil lubricating film thereon. The different hardnesses of the two components which slide against each other avoids a binding engagement and thereby the destruction of the sliding components. In effect, the sliding layer is rubbed off due to its lower hardness relative to the latching component, which concurrently replaces the lubricating effect without the utilization of a special lubricating means. The inventive lubricating layer can comprise a metal alloy with low coefficients of friction, such as nickel-copper or the like. The lubricating layer, pursuant to another inventive feature, evidences a thickness in the magnitude of 0.2 to 0.5 millimeter. Pursuant to a further inventive feature, the coating is applied in a bed formed in the surfaces of the support flaps which, for example, may include undercuts 6*c*, 6*d* in the surfaces.

What is claimed is:

1. A rigidly closing breech lock mechanism for automatic firearms, comprising a plurality of loosely located support flaps in the breech lock mechanism, and a latching and unlatching component associated and complementary with said support flaps, with a substantially rectangular surface of each support flap sliding relative to the surface of said latching component with a high surface contact pressure until said latching component reaches a rearward latching position, and each support flap having a single substantially rectangular bed undercut in said surface and occupying a major portion of the substantially rectangular surface which slides relative to the surface of said latching and unlatching component, and a nickel-copper alloy lubricating coating nondetachably deposited in each bed, said nickel-copper lubricating coating having a depth between 0.2 mm and 0.5 mm, said nickel-coated lubricating coating having a low coefficient of friction and a hardness differing from that of said complementary latching and unlatching component.

* * * * *